US010214043B2

(12) United States Patent
Awano et al.

(10) Patent No.: US 10,214,043 B2
(45) Date of Patent: Feb. 26, 2019

(54) RECORDING-MEDIUM BINDING DEVICE

(71) Applicant: FUJI XEROX CO., LTD., Tokyo (JP)

(72) Inventors: Hiroaki Awano, Kanagawa (JP); Takuya Makita, Kanagawa (JP); Katsumi Harada, Kanagawa (JP); Kojiro Tsutsumi, Kanagawa (JP); Toshiyasu Yukawa, Kanagawa (JP); Takashi Ogino, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/698,790

(22) Filed: Sep. 8, 2017

(65) Prior Publication Data

US 2018/0272785 A1 Sep. 27, 2018

(30) Foreign Application Priority Data

Mar. 22, 2017 (JP) ..... 2017-056052

(51) Int. Cl.

| | |
|---|---|
| ***B31F 5/02*** | (2006.01) |
| ***B42C 1/12*** | (2006.01) |
| ***B65H 37/04*** | (2006.01) |
| ***B42B 5/00*** | (2006.01) |
| ***G03G 15/00*** | (2006.01) |

(52) U.S. Cl.

CPC ..... *B42C 1/12* (2013.01); *B31F 5/02* (2013.01); *B42B 5/00* (2013.01); *B65H 37/04* (2013.01); *G03G 15/6544* (2013.01); *B65H 2301/43828* (2013.01); *B65H 2801/24* (2013.01)

(58) Field of Classification Search

CPC ..... B31F 5/00; B31F 5/02; B31F 2201/0712; B42F 3/006; B65H 37/04; B65H 2801/24; B65H 2301/43828; B65H 2301/51616; G03G 15/6544; G03G 2215/00852; G03G 2215/00848

USPC ..... 270/58.07, 58.08

See application file for complete search history.

(56) References Cited

U.S. PATENT DOCUMENTS

| | | | | |
|---|---|---|---|---|
| 8,333,372 | B2 * | 12/2012 | Awaya | B65H 37/04 270/58.07 |
| 8,983,362 | B2 * | 3/2015 | Nakamura | B65H 37/04 270/58.08 |
| 2016/0107409 | A1 | 4/2016 | Kubo | |
| 2017/0174465 | A1 * | 6/2017 | Morinaga | B31F 5/02 |

(Continued)

FOREIGN PATENT DOCUMENTS

JP 2016-079000 A 5/2016

*Primary Examiner* — Leslie A Nicholson, III

(74) *Attorney, Agent, or Firm* — Sughrue Mion, PLLC

(57) ABSTRACT

A recording-medium binding device includes a first tooth row and a second tooth row. The first tooth row and the second tooth row to be engaged with the first tooth row cooperate with each other to pinch a recording medium batch. The first tooth row and the second tooth row include at least one first region and at least one second region adjacent to the at least one first region. When the first tooth row and the second tooth row are engaged with each other, teeth of the first tooth row and teeth of the second tooth row overlap one another in a tooth height direction by a first engagement overlapping amount in the at least one first region and by a second engagement overlapping amount in the at least one second region. The second engagement overlapping amount is larger than the first engagement overlapping amount.

11 Claims, 4 Drawing Sheets

(56) References Cited

U.S. PATENT DOCUMENTS

| | | | | |
|---|---|---|---|---|
| 2017/0217239 | A1* | 8/2017 | Suzuki | B42C 1/12 |
| 2017/0282482 | A1* | 10/2017 | Awano | B31F 5/02 |
| 2017/0282483 | A1* | 10/2017 | Makita | B31F 5/02 |
| 2017/0283206 | A1* | 10/2017 | Makita | B65H 37/04 |
| 2017/0283207 | A1* | 10/2017 | Makita | B65H 37/04 |

* cited by examiner

RECORDING-MEDIUM BINDING DEVICE

CROSS-REFERENCE TO RELATED APPLICATIONS

This application is based on and claims priority under 35 USC 119 from Japanese Patent Application No. 2017-056052 filed Mar. 22, 2017.

BACKGROUND

(i) Technical Field

The present invention relates to a recording-medium binding device.

(ii) Related Art

There exists a known recording-medium binding device. With this recording-medium binding device, plural recording media that are stacked one on top of another are pinched so as to be subjected to pressure by tooth rows paired with and engaged with each other. As a result, the recording media are deformed into a waveform shape and combined with one another. In such a recording-medium binding device, when the tooth rows paired with each other are engaged with each other, there is an appropriate amount, in accordance with the thickness of a recording medium batch, by which teeth included in the respective tooth rows overlap one another in the tooth height direction (engagement overlapping amount). In the case where the thickness of the recording medium batch is small, recording media are able to be deformed into a wave shape even when the engagement overlapping amount is small. However, when a recording medium batch having a large thickness is pinched so as to be bound by using tooth rows of a small engagement overlapping amount, the recording media are not necessarily sufficiently deformed so as to be combined with one another. Such a recording medium batch having a large thickness is able to be addressed by using tooth rows of a large engagement overlapping amount. In contrast, when a recording medium batch having a small thickness is pinched so as to be bound by using tooth rows of a large engagement overlapping amount, recording media may break, and accordingly, combining of the recording media may fail.

SUMMARY

According to an aspect of the present invention, a recording-medium binding device includes a first tooth row and a second tooth row. The first tooth row includes plural teeth arranged in a tooth arrangement direction. The second tooth row includes plural teeth arranged in the tooth arrangement direction, is to be engaged with the first tooth row, and cooperates with the first tooth row to pinch a recording medium batch so as to bind recording media.

The first tooth row and the second tooth row include at least one first region and at least one second region disposed adjacent to the at least one first region in the tooth arrangement direction. When the first tooth row and the second tooth row are engaged with each other, the plural teeth included in the first tooth row and the plural teeth included in the second tooth row overlap one another in a tooth height direction by a first engagement overlapping amount in the at least one first region and by a second engagement overlapping amount in the at least one second region. The second engagement overlapping amount is larger than the first engagement overlapping amount.

BRIEF DESCRIPTION OF THE DRAWINGS

Exemplary embodiments of the present invention will be described in detail based on the following figures, wherein.

DETAILED DESCRIPTION

Figure 1:
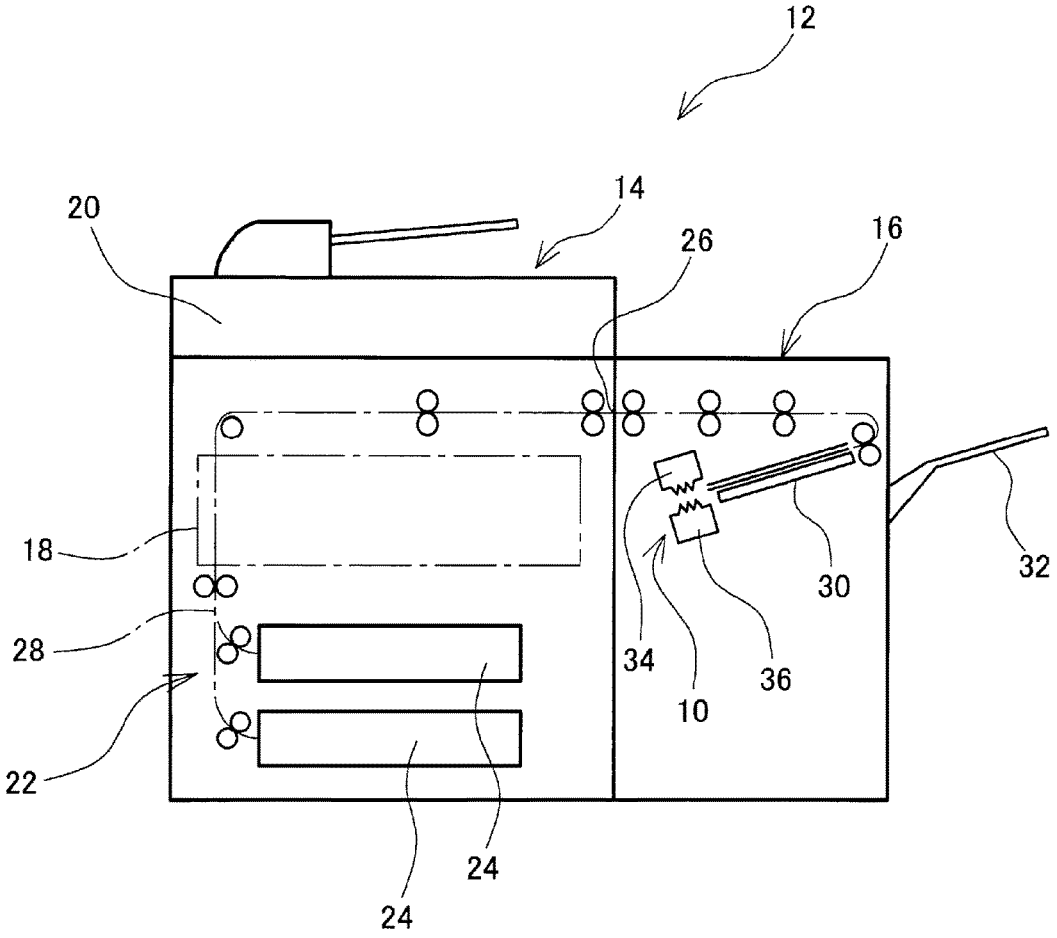
FIG. 1 is a schematic view of the structure of an image forming system.

An exemplary embodiment of the present invention will be described below with reference to the drawings. FIG. 1 is a schematic view of the structure of an image forming system 12 that includes a recording-medium binding device 10 according to the present exemplary embodiment. The image forming system 12 includes an image forming apparatus 14 and a recording-medium post processing apparatus 16. The image forming apparatus 14 has functions such as, for example, electrophotographic printing and copying functions. The recording-medium post processing apparatus 16 performs post processes such as, for example, punching and binding on recording media on which images have been formed by the image forming apparatus 14. The recording-medium binding device 10 according to the present exemplary embodiment is mountable in the recording-medium post processing apparatus 16.

The image forming apparatus 14 includes an image forming section 18 that forms toner images in accordance with obtained document information. The document information may be obtained by reading a document with a document reader 20 included in the image forming apparatus 14 or obtained from an external device. The image forming apparatus 14 further includes a recording-medium feeding mechanism 22. The recording media to be fed are sheet-shaped recording media having been cut into rectangular shapes made of, for example, paper. The recording-medium feeding mechanism 22 includes feed trays 24 and a transport path 28. The feed trays 24 hold the recording media stacked thereon. The transport path 28 allows the recording media to be fed therethrough from the feed trays 24 to an output opening 26. The toner images having been formed by the image forming section 18 are received by and fixed onto the recording media while the recording media are transported through the transport path 28. The recording media having been output through the output opening 26 are received by the recording-medium post processing apparatus 16.

The recording media received by the recording-medium post processing apparatus 16 are accumulated on an accumulation tray 30 according to need so as to form a recording medium batch. In the case where the accumulation is not required, the recording media are fed to an output tray 32.

When a predetermined number of recording media are accumulated on the accumulation tray 30, the recording media are bound by the recording-medium binding device 10. The recording-medium binding device 10 includes two tooth forms 34 and 36 that are paired with each other. Each of the tooth forms 34 and 36 includes plural teeth arranged thereon. For convenience of distinguishing between two tooth forms, the tooth forms illustrated on the upper and lower sides of FIG. 1 are respectively referred to as the upper tooth form 34 and the lower tooth form 36. It is sufficient that two tooth forms 34 and 36 face each other with the recording media to be bound pinched therebetween. For example, the tooth forms 34 and 36 may be respectively arranged on the left and right sides, or the upper tooth form 34 and the lower tooth form 36 may be respectively disposed on the lower and upper sides.

One or both of the upper tooth form 34 and the lower tooth form 36 are advanced toward and retracted from the other or each other by a drive mechanism. When one or both of the upper tooth row and the lower tooth row are advanced, tooth rows of both the tooth forms are engaged with each other. When the tooth rows are engaged with each other, the recording media pinched therebetween are deformed into a wave shape, pressed against one another, combined with one another, and bound to one another. The recording medium batch having been bound is fed to the output tray 32.

Figure 2:
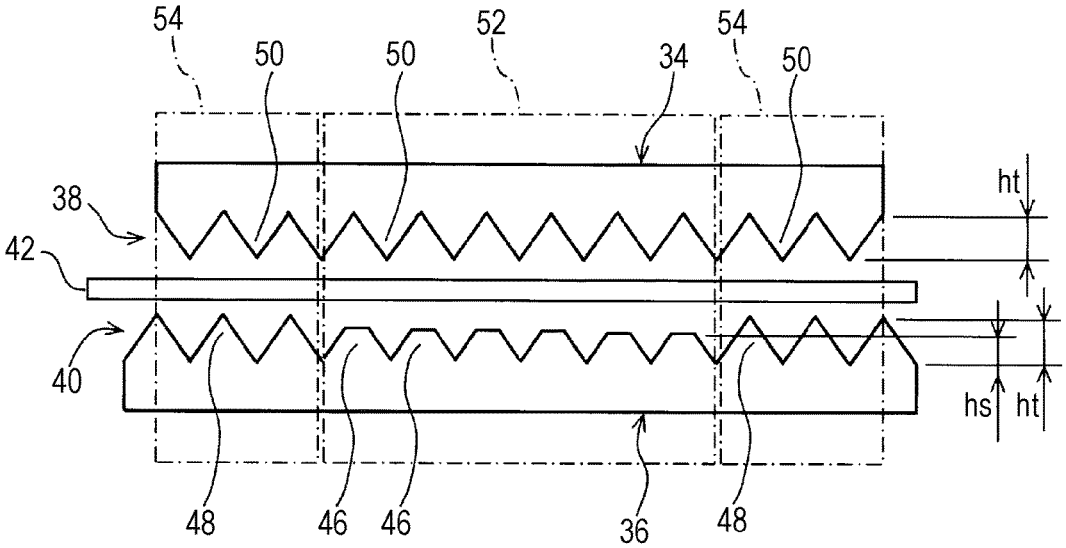
FIG. 2 illustrates an example of tooth rows of a recording-medium binding device.

FIG. 2 illustrates the upper tooth form 34 and the lower tooth form 36. The teeth are arranged in the lateral direction of FIG. 2, thereby the tooth rows are formed. The tooth row of the upper tooth form 34 is referred to as an upper tooth row 38, and the tooth row of the lower tooth form 36 is referred to as a lower tooth row 40. A direction in which the teeth are arranged, that is the lateral direction is referred to as a "tooth arrangement direction". Furthermore, a direction of the height of the teeth, that is, the vertical direction of FIG. 2 is referred to as a "tooth height direction", and a direction perpendicular to the tooth arrangement direction and the tooth height direction is referred to as a "tooth width direction" in the following description.

Figure 3:
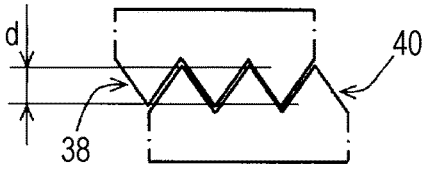
FIG. 3 illustrates an engagement overlapping amount.

Referring to FIG. 2, the upper tooth form 34 and the lower tooth form 36 are separated from each other, being in an open state. The upper tooth form 34 and the lower tooth form 36 in the open state move while facing a recording medium batch 42. When the upper tooth form 34 and the lower tooth form 36 are moved to close the recording-medium binding device 10, the recording medium batch 42 is pinched between the upper tooth row 38 and the lower tooth row 40 and bound. In FIG. 2, part of the recording medium batch 42 is illustrated. When the recording medium batch 42 is pinched between the upper tooth row 38 and the lower tooth row 40, the stacked recording media included in the recording medium batch 42 are, while being stretched in the tooth arrangement direction, deformed into a wave shape and further pressed so as to be combined with one another. Deformation of the recording media varies in accordance with the amount by which the teeth included in the upper tooth row 38 and the teeth included in the lower tooth row 40 are engaged with one another. This amount of mutual engagement of the teeth when the tooth rows 38 and 40 are engaged with each other without pinching the recording medium batch 42 therebetween is defined as an overlapping amount of the teeth included in the tooth rows 38 and 40. As illustrated in FIG. 3, when the tooth rows 38 and 40 are engaged with each other without pinching the recording media therebetween, the distance between tooth tops of the teeth included in the tooth rows 38 and 40 in the vertical direction is defined as an "engagement overlapping amount d".

The recording medium batch 42 is formed by stacking multiple recording media. The thickness of the recording medium batch 42 is small when the number of stacked recording media is small and large when the number of stacked recording media is large. There is an appropriate value of the engagement overlapping amount d of the tooth rows in accordance with the thickness of the recording medium batch 42. When the thickness of the recording medium batch 42 is small and the engagement overlapping amount d is large, the recording media pinched between the tooth rows may be stretched and broken, and accordingly, the recording medium batch 42 is not necessarily able to be bound. Accordingly, when the thickness of the recording medium batch 42 is small, a small engagement overlapping amount d is appropriate. In contrast, when the thickness of the recording medium batch 42 is large and the engagement overlapping amount d is small, it may be impossible to sufficiently deform the recording media into a wave shape, and accordingly, the recording media are not necessarily combined with one another and it may be impossible to bind the recording medium batch 42. Accordingly, when the thickness of the recording medium batch 42 is large, a large engagement overlapping amount d is appropriate.

In this recording-medium binding device 10, in order to address recording medium batches 42 of different thicknesses, the lower tooth row 40 of the lower tooth form 36 includes the teeth of different tooth heights. Teeth (low teeth) 46 having a small tooth height hs are arranged at a central portion of the lower tooth row 40. Teeth (high teeth) 48 having a large tooth height ht are arranged beside both sides of the low teeth 46 (hs<ht). The upper tooth row 38 of the upper tooth form 34 includes teeth 50 that are uniform in tooth height. The tooth height of the teeth 50 of the upper tooth row 38 is able to be the tooth height ht of the high teeth 48 of the lower tooth row 40. Hereafter, the low teeth 46 of the lower tooth row 40 are referred to as "lower low teeth 46", the high teeth 48 of the lower tooth row 40 are referred to as "lower high teeth 48", and the teeth of the upper tooth row 38 are referred to as "upper high teeth 50". The above-described types of teeth are uniform in width.

Figure 4:
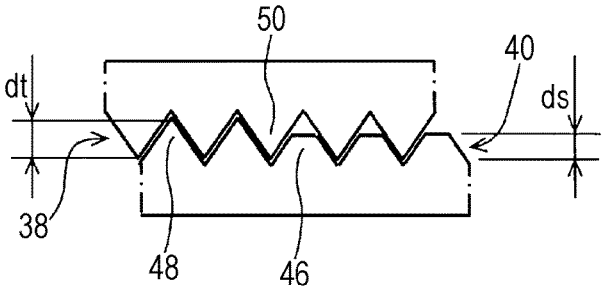
FIG. 4 illustrates the relationship between the tooth height and the engagement overlapping amount.

FIG. 4 illustrates a state in which the upper tooth row 38 and the lower tooth row 40 that includes the teeth of different tooth heights are engaged with each other. When the upper tooth row 38 and the lower tooth row 40 are engaged with each other, the upper high teeth 50 and the lower low teeth 46 are engaged by a small engagement overlapping amount ds, and the upper high teeth 50 and the lower high teeth 48 are engaged by a larger engagement overlapping amount dt than the engagement overlapping amount ds (ds<dt). Accordingly, a combination of the upper high teeth 50 and the lower low teeth 46 is appropriate when the thickness of the recording medium batch 42 is small, and a combination of the upper high teeth 50 and the lower high teeth 48 is appropriate when the thickness of the recording medium batch 42 is large.

A range in the tooth arrangement direction where the lower low teeth 46 exist is a region where the upper tooth row 38 and the lower tooth row 40 are engaged with each other by the small engagement overlapping amount ds. This region corresponds to the recording medium batch 42 having a small thickness. This region defined by the lower low teeth 46 is referred to as a "low tooth region 52". Furthermore, ranges in the tooth arrangement direction where the lower high teeth 48 exist are regions of the large engagement overlapping amount dt. These regions correspond to the recording medium batch 42 having a large thickness. These regions defined by the lower high teeth 48 are referred to as "high tooth regions 54". Boundaries between the low tooth region 52 and the high tooth regions 54 in the lower tooth row 40 are defined by tooth bottoms between the lower low teeth 46 and the adjacent lower high teeth 48, and, in the upper tooth row 38, the boundaries are defined by the tooth tops (tips) or center lines in the tooth arrangement direction of the teeth corresponding to the tooth bottoms. Another boundary of each of the high tooth regions 54 is defined by a tooth top (tip) or a center line in the tooth arrangement direction of the tooth at a corresponding one of ends of the lower tooth row 40. Outer tooth surfaces of the teeth at both the ends of the lower tooth row 40, which are not involved in pinching of the recording medium batch 42, are not included in the high tooth regions 54. In an example illustrated in FIG. 2, the number of teeth included in the low tooth region 52 is 6, and the number of teeth included in one of the two high tooth regions 54 is 2.5. The total number of teeth included in the high tooth regions 54 is 5 (=2.5+2.5).

Figure 5:
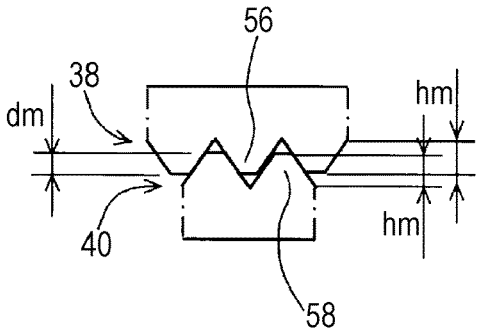
FIG. 5 illustrates the relationship between the tooth height and the engagement overlapping amount.

In order to form the low tooth region 52, the tooth height of the teeth in both the upper tooth row 38 and the lower tooth row 40 may be decreased. FIG. 5 illustrates an example in which teeth 56 and 58 having a tooth height of hm are provided in the upper tooth row 38 and the lower tooth row 40. An engagement overlapping amount dm is the distance between tooth tops of the teeth 56 and 58 in the tooth height direction.

The difference in tooth height between the lower low teeth 46 and the lower high teeth 48 is, for example, from 0.2 to 0.3 mm. When the teeth 56 and 58 having small tooth heights are provided in both the tooth rows 38 and 40 as illustrated in FIG. 5, the difference in dimension set in the case where the low teeth are provided only in one of the tooth rows is divided among the upper and lower tooth rows 38 and 40. This difference may be equally divided (for example, 0.15 mm each) or unequally divided (for example, 0.1 mm and 0.2 mm) among both the tooth rows.

Figure 6:
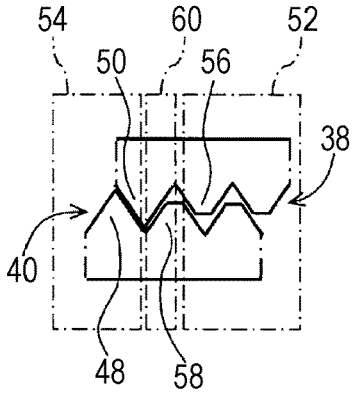
FIG. 6 illustrates the relationships between a low tooth region, a high tooth region, and a transitional region.

Furthermore, when the teeth 56 and 58 having small tooth heights are provided in both the tooth rows 38 and 40, three regions where values of the engagement overlapping amount d are different from one another are formed as illustrated in FIG. 6. That is, transitional regions 60 are formed between the high tooth regions 54 where the engagement overlapping amount d is defined by tooth surfaces of the high teeth 48 and 50 and the low tooth region 52 where the engagement overlapping amount is defined by the low teeth 56 and 58. One of the transitional regions 60 is defined by a tooth surface and a tooth top on the right side of one of the high tooth 50 illustrated in FIG. 6. The engagement overlapping amount in the transitional regions 60 is an intermediate value between those in the low tooth region 52 and the high tooth regions 54. In this case, for convenience, the boundaries between the low tooth region 52 and the high tooth regions 54 are defined as the centers of the transitional regions 60 in the tooth arrangement direction.

Figure 7:
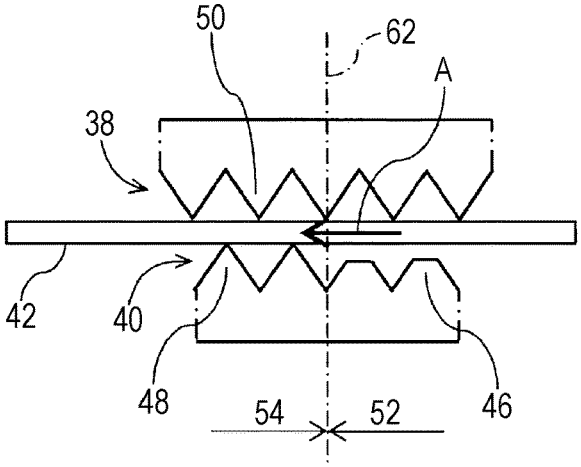
FIG. 7 illustrates a movement of a recording medium batch near a boundary between the low tooth region and the high tooth region.

FIG. 7 illustrates a state in which the tooth tops of the upper tooth row 38 and the lower tooth row 40 abut the recording medium batch 42. When an engaged state is advanced from this state, part of the recording media in each of the high tooth regions 54 is pressed and stretched by the tooth rows 38 and 40 and deformed. At this time, near a boundary 62 with the low tooth region 52, a force acts on the recording medium batch 42 so that the part of the recording medium batch 42 in the high tooth region 54 pulls the part of the recording medium batch 42 in the low tooth region 52 into the high tooth region 54 (see arrow A). As a result, in part of the high tooth region 54 near the boundary 62, the amount of stretching of the recording media decreases compared to the case where the tooth rows include only high teeth. Accordingly, when binding the recording medium batch 42 having a small thickness, breakage of the recording media included in the recording medium batch 42 is suppressed, and accordingly, even the high tooth regions 54 for binding the recording medium batch 42 having a larger thickness partly contributes to binding of the recording medium batch 42 having a small thickness.

Meanwhile, in part of the low tooth region 52 near the boundary 62, the part of the recording medium batch 42 is pulled by the part of the recording medium batch 42 in the high tooth region 54. Thus, the recording medium batch 42 begins to stretch before the recording medium batch 42 is pinched between the lower low teeth 46 and the upper high teeth 50. Accordingly, in the part of the low tooth region 52 near the boundary 62, the amount of stretching of the recording medium batch 42 increases compared to that in the case where the tooth rows include only low teeth. When binding the recording medium batch 42 having a large thickness, the recording media which are originally not sufficiently stretched by the low teeth become able to be further stretched, and accordingly, even the low tooth region 52 partly contributes to binding of the recording medium batch 42 having a large thickness.

When the low tooth region 52 and each of the high tooth regions 54 are adjacent to each other in the tooth arrangement direction as described above, the low tooth region 52 for the recording medium batch 42 having a small thickness also contributes to binding of the recording medium batch 42 having a large thickness, and the high tooth region 54 for the recording medium batch 42 having a large thickness also contributes to binding of the recording medium batch 42 having a small thickness. Accordingly, a larger region than the low tooth region 52 contributes to binding of the recording media of the recording medium batch 42 having a small thickness, and a larger region than the high tooth region 54 contributes to binding of the recording media of the recording medium batch 42 having a large thickness. This means that the length of the tooth rows in the tooth arrangement direction required to obtain a region contributing to the same binding work is smaller with the above-described structure than with a structure in which the low tooth region and the high tooth region are not adjacent to each other in the tooth arrangement direction.

In the case where the low tooth region 52 is disposed in a central portion and the high tooth regions 54 are disposed at both the end portions as is the case with the exemplary embodiment illustrated in FIG. 2, the recording medium batch 42 to be bound is first pinched at both the end portions. Thus, a small amount of the recording media is pulled from the low tooth region 52 into the high tooth regions 54. Accordingly, contribution of the high tooth regions 54 to binding of the recording medium batch 42 having a small thickness is smaller than that with a structure of the tooth rows in which the high tooth region 54 is disposed only one of the end portions. Meanwhile, the recording medium batch 42 is pulled into the high tooth regions 54 from positions farther from the center in the tooth arrangement direction, that is, the opposite sides to the low tooth region 52. Thus, the length of the recording media involved in binding is sufficiently obtained. That is, the recording medium batch 42 is easily pulled into the high tooth regions 54 than into the low tooth region 52. Thus, the length of the recording media involved in binding is more easily obtained in the high tooth regions 54. Accordingly, the number of teeth included in the high tooth regions 54 may be smaller than the number of teeth included in the low tooth region 52. Furthermore, the length of one or both of the upper tooth row 38 and the lower tooth row 40 in the tooth arrangement direction may be decreased.

Furthermore, the number of continuous teeth may contribute to binding of the recording media. As described above, in the case where the low tooth region 52 is formed at the central portion, the number of continuous teeth in the high tooth regions 54 may be smaller than that in the low tooth region 52 because binding is relatively easily performed in the high tooth regions 54. Furthermore, the length of one or both of the upper tooth row 38 and the lower tooth row 40 in the tooth arrangement direction may be decreased.

Figure 8:
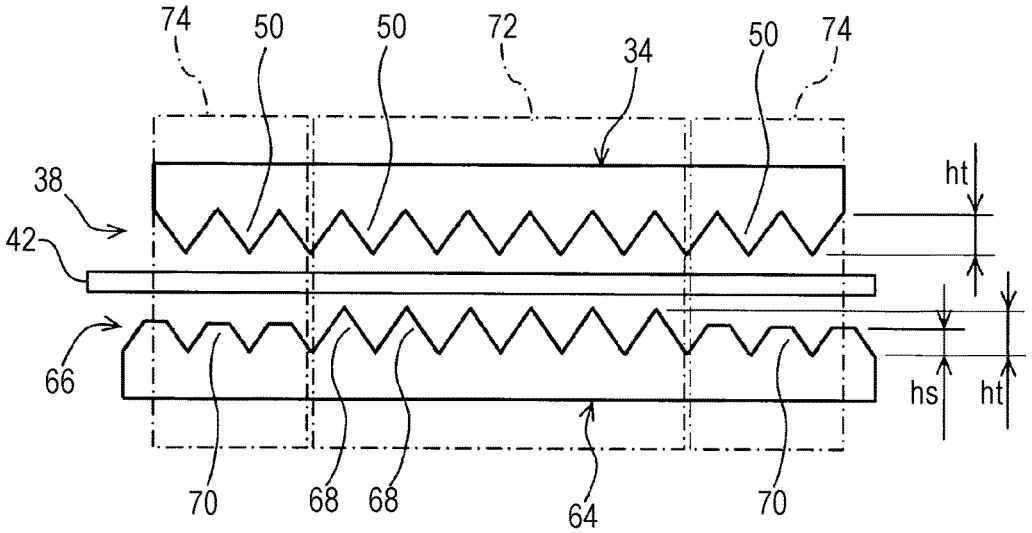
FIG. 8 illustrates another example of tooth rows of the recording-medium binding device.

FIG. 8 illustrates a lower tooth form according to another exemplary embodiment. An upper tooth form is the same as the upper tooth form 34. Accordingly, in the following description, elements included in the upper tooth form 34 are denoted by the same reference numerals as those in the above description. A lower tooth form 64 according to the present exemplary embodiment includes a lower tooth row 66 that includes teeth of various heights. Teeth (high teeth) 68 having a large tooth height ht are disposed at a central portion of the lower tooth row 66. Teeth (low teeth) 70 having a small tooth height hs are arranged beside both sides of the high teeth 68 (hs<ht). Hereafter, the high teeth 68 of the lower tooth row 66 are referred to as "lower high teeth 68", and the low teeth 70 of the lower tooth row 66 are referred to as "lower low teeth 70". The above-described types of teeth are uniform in width.

When the upper tooth row 38 and the lower tooth row 66 are engaged with each other, the upper high teeth 50 and the lower low teeth 70 are engaged by a small engagement overlapping amount ds, and the upper high teeth 50 and the lower high teeth 68 are engaged by a larger engagement overlapping amount dt than the engagement overlapping amount ds (ds<dt). Accordingly, a combination of the upper high teeth 50 and the lower low teeth 70 is appropriate when the thickness of the recording medium batch 42 is small, and a combination of the upper high teeth 50 and the lower high teeth 68 is appropriate when the thickness of the recording medium batch 42 is large. According to the exemplary embodiment illustrated in FIG. 8, a high tooth region 72 of a large engagement overlapping amount dt is formed at the center of the tooth rows 38 and 66, and low tooth regions 74 of a small engagement overlapping amount ds are formed adjacent to both sides of the high tooth region 72 in the tooth arrangement direction. Boundaries between the high tooth region 72 and the low tooth regions 74 in the lower tooth row 66 are defined by tooth bottoms between the lower high teeth 68 and the adjacent lower low teeth 70, and, in the upper tooth row 38, the boundaries are defined by the tooth tops (tips) or center lines in the tooth arrangement direction of the teeth corresponding to the tooth bottoms. Another boundary of each of the low tooth regions 74 is defined by a center line in the tooth arrangement direction of the tooth at a corresponding one of ends of the lower tooth row 66. Outer tooth surfaces of the teeth at both the ends of the lower tooth row 66, which are not involved in pinching of the recording medium batch 42, are not included in the low tooth regions 74. As has been described, the high tooth region 72 corresponds to the recording medium batch 42 having a large thickness, and the low tooth regions 74 correspond to the recording medium batch 42 having a small thickness.

In an example illustrated in FIG. 8, the number of teeth included in the high tooth region 72 is 6, and the number of teeth included in one of the two low tooth regions 74 is 2.5. The total number of teeth included in the low tooth regions 74 is 5 (=2.5+2.5).

The difference in tooth height between the lower high teeth 68 and the lower low teeth 70 is, for example, from 0.2 to 0.3 mm. In order to form the low tooth regions 74, the tooth height of the teeth in both the upper tooth row 38 and the lower tooth row 66 may be decreased similarly to the structure having been described with reference to FIG. 5. In this case, the difference in dimension set in the case where the low teeth are provided only in one of the tooth rows is divided among the upper and lower tooth rows 38 and 66. This difference may be equally divided (for example, 0.15 mm each) or unequally divided (for example, 0.1 mm and 0.2 mm) among both the tooth rows.

When the low teeth are provided in both the upper tooth row 38 and the lower tooth row 66, as has been described, three regions where values of the engagement overlapping amount are different from one another are formed. In this case, for convenience, the centers of the transitional regions 60 in the tooth arrangement direction are defined as the boundaries between the high tooth region 72 and the low tooth regions 74. In the transitional regions, the engagement overlapping amount is an intermediate value.

As is the case with the exemplary embodiment illustrated in FIG. 8, when the high tooth region 72 is disposed at the central portion and the low tooth regions 74 are disposed at both the end portions, the recording medium batch 42 to be bound is first pinched in the high tooth region 72 at the central portion and starts to be deformed. Due to the deformation of the recording media in the high tooth region 72, part of the recording medium batch 42 in each of the low tooth regions 74 is pulled into the high tooth region 72. Since parts of the recording medium batch 42 disposed in the low tooth regions 74 and disposed at a position farther from the center in the tooth arrangement direction than the low tooth regions 74 are not restrained, the amount of the recording medium batch 42 pulled into the high tooth region 72 is larger than that when the recording medium batch 42 is restrained. Thus, stretching of the recording media is suppressed near the boundary with the adjacent low tooth regions 74 in the high tooth region 72, and, when binding the recording medium batch 42 having a small thickness, breakage is suppressed. Accordingly, even the high tooth region 72 for binding the recording medium batch 42 having a larger thickness partly contributes to binding of the recording medium batch 42 having a small thickness. Meanwhile, since part of the recording media near the boundary with the adjacent high tooth region 72 in each of the low tooth regions 74 is not restrained at the opposite boundary or at a position further from the center in the tooth arrangement direction than the tooth rows 38 and 66, the amount of stretching is small compared to the restrained part and contribution to binding of the recording medium batch 42 having a large thickness is limited. That is, regarding stretching of the recording media, suppressing the stretching at the end portions of the high tooth region 72 usefully acts, so that, when binding the recording medium batch 42 having a small thickness, a region that practically contributes to the binding becomes larger than the physical low tooth regions 74. Accordingly, the number of teeth included in the low tooth regions 74 may be smaller than the number of teeth included in the high tooth region 72. Furthermore, the length of one or both of the upper tooth row 38 and the lower tooth row 66 in the tooth arrangement direction may be decreased.

Furthermore, the number of continuous teeth may contribute to binding of the recording media. As described above, in the case where the high tooth region 72 is formed at the central portion, since part of the high tooth region 72 contributes to binding of the recording medium batch 42 having a small thickness, the number of continuous teeth in the low tooth regions 74 corresponding to the recording medium batch 42 having a small thickness may be smaller than that in the high tooth region 72. Furthermore, the length of one or both of the upper tooth row 38 and the lower tooth row 66 in the tooth arrangement direction may be decreased.

Although the tooth heights and the engagement overlapping amounts are determined in accordance with the positions of the tooth tops while the tooth bottoms of the teeth are aligned with one another according to the above-described embodiments, this is not limiting. For example, the tooth heights and the engagement overlapping amounts may be determined in accordance with the positions of the tooth bottoms while the tooth tops are aligned with one another.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-medium binding device comprising:

a first tooth row that includes a plurality of teeth arranged in a tooth arrangement direction; and a second tooth row that includes a plurality of teeth arranged in the tooth arrangement direction, that is to be engaged with the first tooth row, and that cooperates with the first tooth row to pinch a recording medium batch so as to bind recording media, wherein the first tooth row and the second tooth row include at least one first region and at least one second region disposed adjacent to the at least one first region in the tooth arrangement direction, wherein, when the first tooth row and the second tooth row are engaged with each other, the plurality of teeth included in the first tooth row and the plurality of teeth included in the second tooth row overlap one another in a tooth height direction by a first engagement overlapping amount in the at least one first region and by a second engagement overlapping amount in the at least one second region, wherein the second engagement overlapping amount is larger than the first engagement overlapping amount, wherein the at least one second region includes two second regions, and wherein the at least one first region having one side and another side in the tooth arrangement direction is positioned at a center in the tooth arrangement direction, and the two second regions are adjacent to the one side and the other side of the at least one first region in the tooth arrangement direction.

2. The recording-medium binding device according to claim 1, wherein, out of the plurality of teeth, a number of teeth included in the two second regions is smaller than a number of teeth included in the at least one first region in each of the first tooth row and the second tooth row.

3. The recording-medium binding device according to claim 1, wherein, out of the plurality of teeth, a number of teeth continuous with one another and included in the two second regions is smaller than a number of teeth continuous with one another and included in the at least one first region in each of the first tooth row and the second tooth row.

4. A recording-medium binding device comprising:

a first tooth row that includes a plurality of teeth arranged in a tooth arrangement direction; and a second tooth row that includes a plurality of teeth arranged in the tooth arrangement direction, that is to be engaged with the first tooth row, and that cooperates with the first tooth row to pinch a recording medium batch so as to bind recording media, wherein the first tooth row and the second tooth row include at least one first region and at least one second region disposed adjacent to the at least one first region in the tooth arrangement direction, wherein, when the first tooth row and the second tooth row are engaged with each other, the plurality of teeth included in the first tooth row and the plurality of teeth included in the second tooth row overlap one another in a tooth height direction by a first engagement overlapping amount in the at least one first region and by a second engagement overlapping amount in the at least one second region, wherein the second engagement overlapping amount is larger than the first engagement overlapping amount, wherein the at least one first region includes two first regions, wherein the at least one second region having one side and another side in the tooth arrangement direction is positioned at a center in the tooth arrangement direction, and the two first regions are adjacent to the one side and the other side of the at least one second region in the tooth arrangement direction, and wherein, out of the plurality of teeth, a number of teeth included in the two first regions is smaller than a number of teeth included in the at least one second region in each of the first tooth row and the second tooth row.

5. A recording-medium binding device comprising:

a first tooth row that includes a plurality of teeth arranged in a tooth arrangement direction; and a second tooth row that includes a plurality of teeth arranged in the tooth arrangement direction, that is to be engaged with the first tooth row, and that cooperates with the first tooth row to pinch a recording medium batch so as to bind recording media, wherein only one of the first tooth row and the second tooth row includes at least one low tooth region formed by a tooth or teeth having a first tooth height out of the plurality of teeth and at least one high tooth region formed by a tooth or teeth having a second tooth height out of the plurality of teeth, and wherein the second tooth height is larger than the first tooth height.

6. The recording-medium binding device according to claim 5, wherein the at least one low tooth region includes two low tooth regions, and wherein the at least one high tooth region having one side and another side in the tooth arrangement direction is positioned at a center in the tooth arrangement direction, and the two low tooth regions are adjacent to the one side and the other side of the at least one high tooth region in the tooth arrangement direction.

7. The recording-medium binding device according to claim 6, wherein, out of the plurality of teeth, a number of teeth continuous with one another and included in the two low tooth regions is smaller than a number of teeth continuous with one another and included in the at least one high tooth region in one or both of the first tooth row and the second tooth row.

8. A recording-medium binding device comprising:

a first tooth row that includes a plurality of teeth arranged in a tooth arrangement direction; and a second tooth row that includes a plurality of teeth arranged in the tooth arrangement direction, that is to be engaged with the first tooth row, and that cooperates with the first tooth row to pinch a recording medium batch so as to bind recording media, wherein at least one of the first tooth row and the second tooth row includes at least one low tooth region formed by a tooth or teeth having a first tooth height out of the plurality of teeth and at least one high tooth region formed by a tooth or teeth having a second tooth height out of the plurality of teeth, wherein the second tooth height is larger than the first tooth height, wherein the at least one high tooth region includes two high tooth regions, and wherein the at least one low tooth region having one side and another side in the tooth arrangement direction is positioned at a center in the tooth arrangement direction, and the two high tooth regions are adjacent to the one side and the other side of the at least one low tooth region in the tooth arrangement direction.

9. The recording-medium binding device according to claim 8, wherein, out of the plurality of teeth, a number of teeth included in the two high tooth regions is smaller than a number of teeth included in the at least one low tooth region in one or both of the first tooth row and the second tooth row.

10. The recording-medium binding device according to claim 8, wherein, out of the plurality of teeth, a number of teeth continuous with one another and included in the two high tooth regions is smaller than a number of teeth continuous with one another and included in the at least one low tooth region in one or both of the first tooth row and the second tooth row.

11. A recording-medium binding device comprising:

a first tooth row that includes a plurality of teeth arranged in a tooth arrangement direction; and a second tooth row that includes a plurality of teeth arranged in the tooth arrangement direction, that is to be engaged with the first tooth row, and that cooperates with the first tooth row to pinch a recording medium batch so as to bind recording media, wherein at least one of the first tooth row and the second tooth row includes at least one low tooth region formed by a tooth or teeth having a first tooth height out of the plurality of teeth and at least one high tooth region formed by a tooth or teeth having a second tooth height out of the plurality of teeth, wherein the second tooth height is larger than the first tooth height, wherein the at least one low tooth region includes two low tooth regions, wherein the at least one high tooth region having one side and another side in the tooth arrangement direction is positioned at a center in the tooth arrangement direction, and the two low tooth regions are adjacent to the one side and the other side of the at least one high tooth region in the tooth arrangement direction, and wherein, out of the plurality of teeth, a number of teeth included in the two low tooth regions is smaller than a number of teeth included in the at least one high tooth region in one or both of the first tooth row and the second tooth row.

* * * * *